United States Patent [19]

Zeyher

[11] Patent Number: 4,796,427

[45] Date of Patent: Jan. 10, 1989

[54] METHOD OF IMPARTING ENERGY TO LIQUIDS

[76] Inventor: Craig H. Zeyher, 660 Clinton Ave., Haddonfield, N.J. 08033

[21] Appl. No.: 58,651

[22] Filed: May 21, 1987

Related U.S. Application Data

[63] Continuation-in-part of Ser. No. 733,656, May 13, 1985, abandoned.

[51] Int. Cl.[4] ..... F03B 13/00

[52] U.S. Cl. ..... 60/398

[58] Field of Search ..... 60/398, 721; 137/1, 137/13; 290/1 R; 417/572

[56] References Cited

FOREIGN PATENT DOCUMENTS 1047735 11/1966 United Kingdom .

*Primary Examiner*—Stephen F. Husar

[57] ABSTRACT

A method of utilizing centrifugal forces generated by the earth's rotation through positioning of conduit means containing liquid in critical and predetermined relation to such forces while concomitantly minimizing the adverse effects of the earth's gravitational forces on that system thereby to induce fluid flow. One means for accomplishment of the above is the employment of an elongated conduit system in which, under steady state conditions, the liquid media contained within the system is essentially in equilibrium in relation to the earth's gravitational field. The longitudinal section interconnecting the inlet and outlet portions is maintained at a substantially uniform depth relative to the earth's surface while at the same time being oriented in a direction relative to the earth's centrifugal forces so as to maximize the effect of such forces on the liquid contained within the section thereby to produce a velocity head sufficient to drive a turbo-generating system to produce electric power.

6 Claims, 3 Drawing Sheets

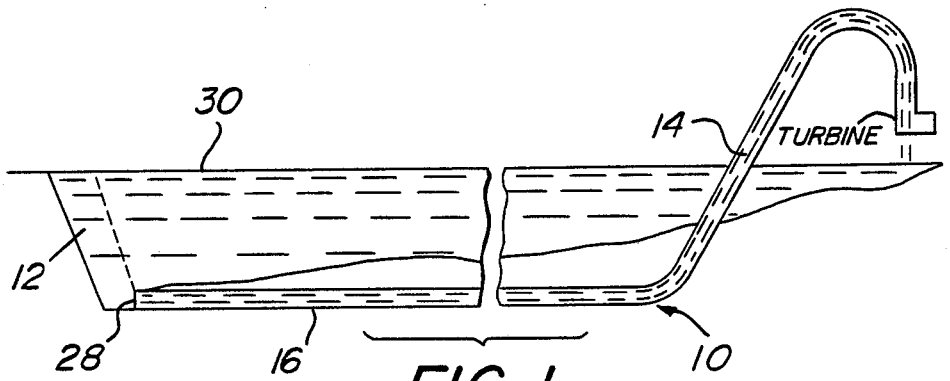
FIG. 1
FIG. 2
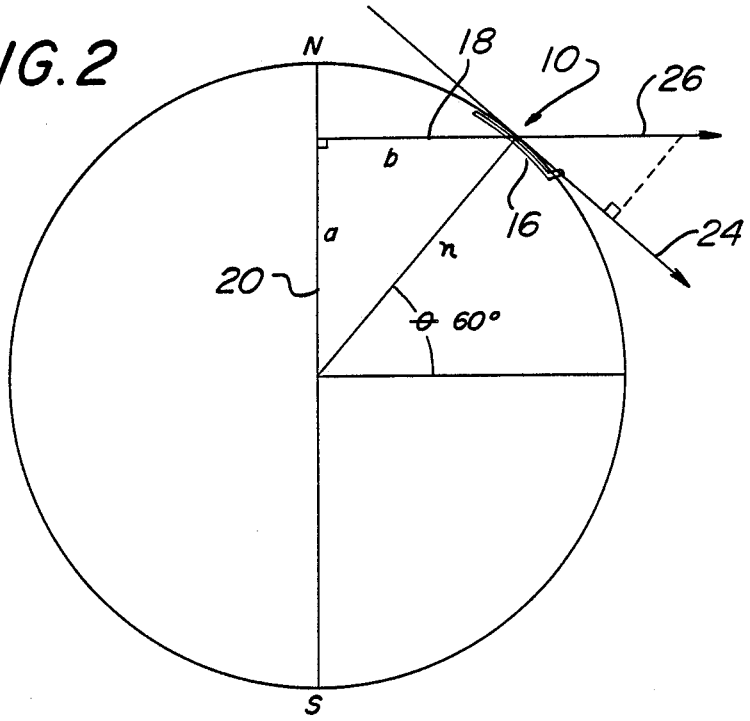

FIG. 3
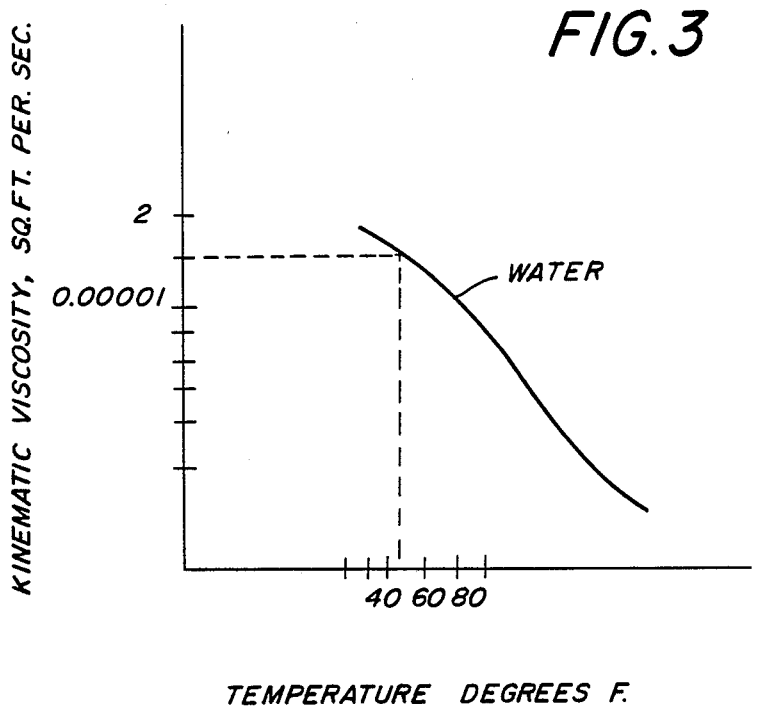
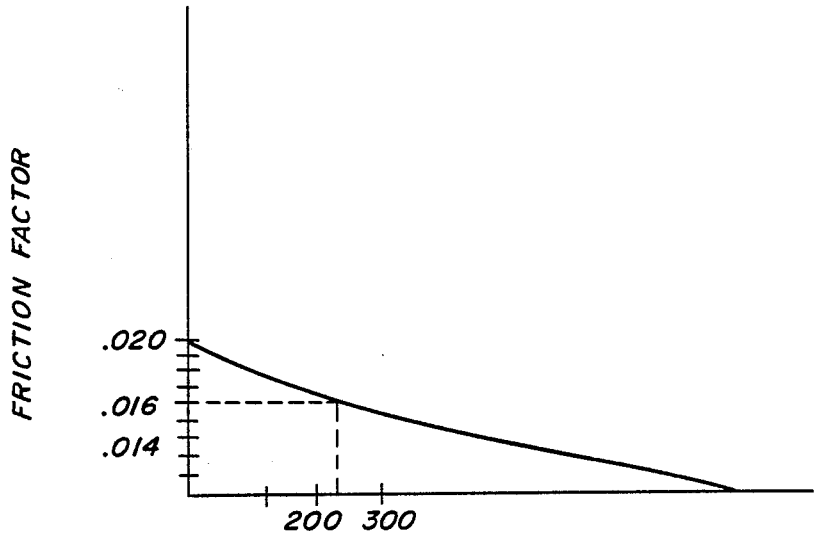
FIG. 4

METHOD OF IMPARTING ENERGY TO LIQUIDS

This is a continuation-in-part of application Ser. No. 733,656 filed on May 13, 1985 now abandoned.

BACKGROUND OF THE INVENTION

One of the principle problems facing the country over the next several decades is a potential shortage of energy. Current efforts at solving this problem have been directed to the negative approach of having the country use less energy. While this may delay the problem it in no way provides a solution. If a solution is not forthcoming in the immediate future the world faces an industrial slow down which can only have dire socio-economic effects on all peoples of the world. It has been forecasted by reliable sources that the world's need for oil, one of the primary sources of todays energy will outrun the supply by the end of the century and possibly sooner. This makes the development of alternative sources of energy a national imperative. This invention is directed to the development of such an alternative source of energy and provides a unique method for extracting energy from bodies of water. The method is pollutionless, does not degrade or taint our natural resources and is for all practical purposes limitless in its capacity for power generation.

The manner in which the foregoing, as well as other objectives and advantages of the invention may best be achieved will be more fully understood from a consideration of the following description, taken in light of the accompanying drawings.

SUMMARY OF THE INVENTION

This invention relates to a unique method for developing power through use of the earth's natural forces. The system in its broadest concept comprises placing suitably proportioned fluid-conduit means within a body of water such that the earth's gravitational and centrifugal force fields acting on the system are moderated in a manner to neutralize the effects of the gravitational force field while concomitantly maximizing the effects of the earth's centrifugal force field. More specifically the inventive concept when applied, for example, to the extraction of power from a body of water, comprises placing a relatively large diameter pipe within the body of water and then longitudinally orienting the pipe within the earth's centrifugal and gravitational force fields to induce flow of water through the pipe of sufficient volume and velocity to produce useful work. The theory underlying the invention is first to neutralize to the fullest practical extent the adverse effect of gravity on the system. I have discovered that if a conduit is supplied with liquid and properly oriented longitudinally with respect to the earth's surface the radial and tangential components of the centrifugal force generated by the earth's rotation will respectfully neutralize the gravitational pull of the earth and provide a translational force which can be used to impart to the liquid contained within the conduit a velocity head sufficient to do useful work, as for example, by driving a turbo-generating system to produce electric power. The next step is to longitudinally orient the system in the centrifugal force field of the earth such that the centrifugal forces acting on the system are maximized in the direction of intended flow. The centrifugal forces generated by the rotation of the earth act in a direction perpendicular to the axis of rotation of the earth. To maximize the effect of these forces on the body of water contained within the longitudinal section of the pipe the pipe is required to be oriented in a generally north-south direction when working in the northern hemisphere and in a generally south-north direction when working in the southern hemisphere. The third objective is to minimize frictional losses. This is accomplished by using pipe of large diameter having smooth inner surfaces and gradual transitions when changes in direction of flow are required. The practical extension of this inventive concept is described in detail below.

BRIEF DESCRIPTION OF THE DRAWING

FIG. 1 illustrates in schematic form one manner of utilizing the present invention to provide a driving head of water to a turbo-generating system, FIG. 2 is a graphic depiction of the preferred method of orienting the system relative to the gravitational and centrifugal force fields of the earth.

FIG. 3 is a graph illustrating values of kinematic viscosity for water at various degrees of temperature, FIG. 4 is a plot of Reynolds numbers versus friction factors for various types of pipe and roughness derived by empirical means.

DESCRIPTION OF THE PREFERRED EMBODIMENT

Figure 5:
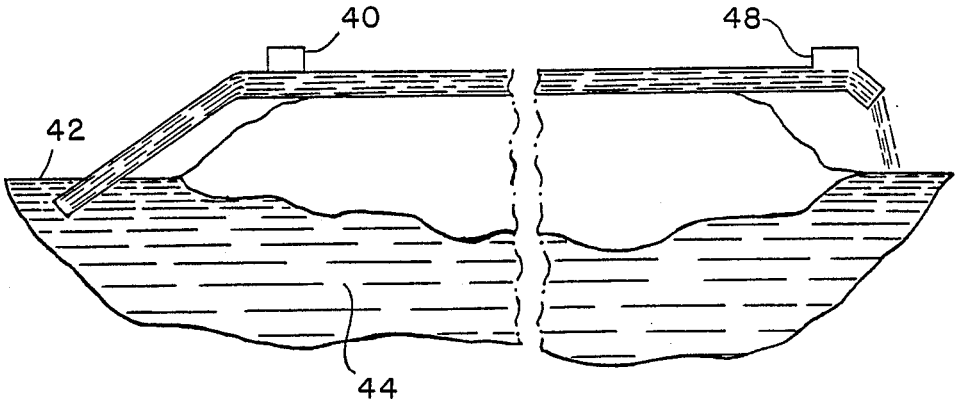
FIG. 5 illustrates an alternative embodiment of the invention.

With specific referance to the drawing there is shown in FIG. 1 the basics of a system incorporating the methodology of operation comprising one aspect of the invention. Reduced to its simplest form the system consists of liquid conduit means 10 comprising inlet and outlet sections 12 and 14 respectively seperated by a longitudinal section 16. The system is proportioned and arranged to minimize friction losses by eliminating abrupt transitions in flow patterns and by providing a conduit having a smooth inner surface and a substantial cross sectional diameter. In the embodiment shown the conduit is made of steel pipe of eight foot diameter having an inner polished surface. The longitudinal section 16 and inlet and outlet sections 12 and 14 are then positioned in the earth's gravitational and centrifugal force fields in a manner to neutralize to the fullest extent possible any adverse effects of gravity on the system while maximizing the effects of the earth's centrifugal force field in order to augment fluid flow through the system. By providing the arrangement shown in FIG. 1 the inlet leg 12 of the system, as shown in phantom, in FIG. 1 is effectively provided by the body of water 18 which serves as a forebay for furnishing the systems operating head. This eliminates the need for inlet piping and its associated friction losses. The longitudinal section 16 of the system is generally maintained throughout its length at a more or less constant depth from the surface to minimize gravitationally induced losses. In the illustration, section 16 is assumed to be approximately twenty five miles long. It is on this basis that the computations set out in this disclosure are made.

For purposes of illustration, referring to FIG. 2, system 10 has been choosen as being in the northern hemisphere at a latitude of sixty degrees. While the earth is in fact an oblate spheroid we will assume its shape to be spherical. This simplifies the computation without compromising its basic accuracy. The centrifugal forces acting on the slug of water existing at any instant of time within the longitudinal section 16 of the pipe act through a radius arm 18 having a length of 1,979.5 miles measured from the rotational axis 20 of the earth to the center of gravity 22 of the slug of liquid contained within the pipe. To maximize the centrifugal force acting on the water, the pipe section 16 is longitudinally oriented such that the componet 24 of the earth's centrifugal force 26, as seen in FIG. 2, acts in a direction parallel to the selected flow path and in a direction which augments fluid flow. In the Northern Hemisphere the orientation of the system is in a North-South direction and the direction of fluid flow is from North to South. With the system so positioned flow of water into and through the system is initiated by opening a gate valve 28 located at the entrance to the system. The pressure head 30 acts to provide the initial thrust to initiate fluid flow. For purposes of illustration this starting head has been choosen as thirty feet. The prime mover for the system, however, is the centrifugal force generated by the earth's rotation. No gravitational forces are required to be overcome during movement of the water through the longitudinal section 16 of the pipe by reason of its uniform depth as measured in respect to the earth's surface. The radial component of the earth's centrifugal force effectively neutralizes the gravitational pull. The only forces required to be overcome in order to life the water back to the earth's surface is that caused by frictional losses. Any head generated in excess of this frictional loss can be used to produce useful work such, for example, as simply moving water from one location to another or for generating a head of water necessary to power a turbo-generating system as is well known in the art.

Before elaborating on the use of the invention reference should again be made to FIG. 2 in order to understand the procedure for orienting the system 10 in the earth's gravitational and centrifugal force fields. As previously noted the system is assumed to be located at a north latitude of 60 degrees. At this latitude the radius of rotation of an object located on or near the earth's surface is approximately 1,979.5 miles. This is determined by multiplying the earth's radius of 3,959 miles by the Cosine of 60 degrees. Accordingly the centrifugal force represented by the vector 26 acts through a radius arm of 1,979.5 miles in a radial direction. To maintain the system in substanially gravitational equilibrium, as already discussed, while at the same time maximizing the effect of the earth's centrifugal force on the system requires the system to be oriented in a north-south direction and the fluid flow to be in a north to south direction. Given this orientation of the system the magnitude of the component of the earth's centrifugal force, 24, acting in a direction parallel to the flow path is equal to the Cosine of 30 degrees multiplied by the value of the earth's centrifugal force at a northern latitude of 60 degrees. The formula for determining centrifugal force is $F=MRW^2$, where "M" stands for the mass of the object being acted on, "R" the radius arm through which the centrifugal force acts and "W" the angular velocity expressed in radians per second. Given a system in which the diameter of the pipe is 8 feet, the longitudinal length of the pipe is 25 miles, the system is located at north latitude 60 degrees and is positioned in the manner described above the formula can be rewritten as follows; $F=W/G\times R\times W^2$. The weight of fluid on which the centrifugal force acts is the body of fluid, in the illustrated embodiment the fluid is assumed to be water, contained within the 25 mile long 8 foot diameter pipe and is equivalent to the area of the pipe multiplied by its length in feet times the density of water. In mathematical terms the weight of water in the above described system is equal to $(3.14)\times R^2\times$length of the pipe in feet$\times$density of water or in the system selected for illustration $(3.14)\times 16\times 25(5,280)\times 64$ lbs./ft$^3$=(50.24) (132,000) (64)=424,427,520 pounds. This weight is then divided by the gravitational force of the earth to obtain the mass. Multiplying this by the radius of the centrifugal force arm of 1,979.5 miles expressed in feet and the velocity of the earth's rotation expressed in radians per second squared gives a force F=726,710 lbs. The component of the centrifugal force which acts along the longitudinal section of pipe at a northern latitude of 60 degrees is obtained by multiplying the centrifugal force by the cosine of 30 degrees. Hence the component of centrifugal force acting along the axis of the longitudinal section of pipe is 629,330 pounds of force. This equates to a head of approximately 195 feet. To determine the useful head one has to substract from the gross head of 195 feet losses due to friction. For a straight pipe of uniform diameter, assuming laminar flow, friction losses are given by the formula $h_f=32v\ LV/gd^2$, where v is the kinematic viscosity is square feet per second, L is the length of pipe in feet, V the mean velocity of fluid in feet per second, g the acceleration of gravity in feet per second per second and d the diameter of the pipe in feet. The resultant head along with any starting head initiates and augments flow within the pipe. Accordingly the exit velocity can be computed from the formula $V^2=2gh$. With an operating head of 190 feet assuming friction losses equivalent to approximately 5 feet of operating head, V=110.61 feet/second.

Referring to FIG. 3, the kinematic viscosity for salt water at 50 degrees Fahrenheit is given as approximately. 00002. Given the above factors the losses due to friction equate to a loss of head of approximately 5 feet. In addition to the frictional losses computed above there are frictional losses due to pipe bends. In the FIG. 1 illustrated embodiment there a three such bends, each bend corresponding to an additional 55 feet of pipe per bend or a total of an additional 165 feet of pipe, this assumes a bending radius of 30 feet per bend. It also assumed that the inlet section of the pipeline employs a bellmouthed opening so as to eliminate friction losses at the point of entry to the pipeline.

It will be seen by reference to the above formula for losses due to friction, that the losses due to the addition of 165 feet of pipe are inconsequential. Power developed by the system is given by the formula P=WH, where W is the weight per unit time in pounds per second and H the operating head. For salt water with a specific weight of 64 pounds per cubic foot the system develops 122,861 horsepower or roughly 94 megawatts of power.

By comparison a system using a 10 mile long pipe of six foot diameter generates 17,484 horsepower or approximately 13 megawatts of power.

Another embodiment of the invention is shown in FIG. 5. In this embodiment the system is primed through use of a pump 40. Once primed and operational the system will continue to run without pump assist. However it is preferable to continue operation of the pump and to place it at the highest point in the system to remove released air and thus maintain an unbroken liquid column within the feed system. For optimum operation the distance from the surface 42 of the body of water 44 to the highest point in the system, should be held to something less than 30 feet. Atmospheric pressure acting on the surface of the water continues to provide the operating head for the system as long as fluid is available and the centrifugal forces acting on the system are sufficient to maintain fluid flow and overcome frictional losses. In this embodiment the turbine 48 is impacted directly by the mass of water flowing through the system.

The present invention may be embodied in other specific forms without departing from the spirit or essential attributes thereof and, accordingly, referance should be made to the appended claims, rather than to the foregoing specification, as indicating the scope of the invention.

I claim:

1. A method of generating electrical power, which comprises:

a. providing liquid-conduit means;

b. furnishing liquid to said means;

c. longitudinally orienting said means in the centrifugal force field of the earth to produce flow of liquid within said means to develop a velocity head sufficient to drive a turbo-generating system to produce electrical power.

2. A method of generating electrical power in accordance with claim 1 wherein said means comprises a longitudinal section of pipe several feet in diameter and several miles in length.

3. The method of claim 1 wherein said liquid-conduit means includes inlet and outlet portions and the step of furnishing liquid to said liquid-conduit means comprises impressing on said inlet portions a head of liquid sufficient to initiate liquid flow.

4. The method of claim 1 wherein said liquid-conduit means includes inlet and outlet portions and the step of furnishing liquid to said liquid-conduit means comprises supplying water to said inlet portions by pump means to initiate liquid flow.

5. The method of claim 1 wherein said liquid-conduit means includes inlet and outlet portions and the step of furnishing liquid to said liquid-conduit means comprises immersing said inlet portions in a body of water, initiating liquid flow by pump means and maintaining liquid flow by the coaction of centrifugal forces acting on the liquid traversing said liquid-conduit means and the atmospheric pressure acting on said body of water.

6. A method of generating electrical power which comprises:

a. providing liquid-conduit means;

b. furnishing liquid to said means;

c. longitudinally orienting said means in the centrifugal force field of the earth to produce flow of liquid within said means; and d. passing said liquid flow through a turbo-generating system and producing electrical power.

* * * * *